US011696638B2

(12) United States Patent
James

(10) Patent No.: US 11,696,638 B2
(45) Date of Patent: Jul. 11, 2023

(54) CONVERTIBLE TABLE

(71) Applicant: Four Board Woodworks, LLC, Louisville, KY (US)

(72) Inventor: Edward Neal James, Louisville, KY (US)

(73) Assignee: Four Board Woodworks, LLC, Louisville, KY (US)

( * ) Notice: Subject to any disclaimer, the term of this patent is extended or adjusted under 35 U.S.C. 154(b) by 0 days.

(21) Appl. No.: 17/318,483

(22) Filed: May 12, 2021

(65) Prior Publication Data

US 2021/0353049 A1 Nov. 18, 2021

Related U.S. Application Data

(60) Provisional application No. 63/024,288, filed on May 13, 2020.

(51) Int. Cl.
*A47B 9/16* (2006.01)
*A47B 9/00* (2006.01)

(52) U.S. Cl.
CPC ..... *A47B 9/16* (2013.01); *A47B 2009/006* (2013.01); *A47B 2200/0056* (2013.01)

(58) Field of Classification Search
CPC ..... A47B 9/16; A47B 2009/006; A47B 2200/0056; A47B 21/0314; A47B 21/00; A47B 21/02; A47B 21/03; A47B 3/02; A47B 3/0809; A47B 3/0815; A47B 3/00; A47B 61/00; B25H 1/16; B25H 1/02
USPC ..... 108/147.22, 147, 116–120, 43, 138, 12, 108/19, 20, 144.11, 145, 93, 96, 50.01, 108/50.02; 248/421, 562, 588, 585, 431, 248/432, 439
See application file for complete search history.

(56) References Cited

U.S. PATENT DOCUMENTS

| | | | | | |
|---|---|---|---|---|---|
| 636,445 | A * | 11/1899 | McCabe | | |
| 2,070,468 | A | 2/1937 | Chapman | | |
| 4,259,909 | A | 4/1981 | Belina | | |
| 4,303,018 | A | 12/1981 | Lehmann | | |
| 4,718,355 | A * | 1/1988 | Houghton | A47B 9/16 | 108/147 |
| 6,024,025 | A | 2/2000 | Koch | | |
| 6,974,185 | B2 * | 12/2005 | Hsieh | A47C 9/10 | 108/118 |
| 8,215,241 | B2 * | 7/2012 | Garneau | B60N 3/001 | 248/162.1 |
| 8,490,555 | B1 * | 7/2013 | Agee | A47B 9/04 | 108/147 |
| 9,808,080 | B2 | 11/2017 | Chung | | |
| 10,092,089 | B1 | 10/2018 | Yuan | | |
| 10,426,259 | B2 | 10/2019 | Patton | | |

(Continued)

FOREIGN PATENT DOCUMENTS

| | | | |
|---|---|---|---|
| CN | 107048692 | * | 8/2017 |
| CN | 108158208 | A | 6/2018 |

(Continued)

OTHER PUBLICATIONS

CN 107048692 English translation (Year: 2017).*

*Primary Examiner* — Janet M Wilkens
(74) *Attorney, Agent, or Firm* — Dinsmore & Shohl LLP

(57) ABSTRACT

A convertible table is disclosed. The convertible table may comprise a tabletop, a plurality of supporting legs, a plurality of leg mounting tracks, and a table converting mechanism.

22 Claims, 6 Drawing Sheets

(56) References Cited

U.S. PATENT DOCUMENTS

| | | | | |
|---|---|---|---|---|
| 10,499,730 | B2 | 12/2019 | Kim | |
| 11,047,520 | B1 * | 6/2021 | Schwind | A47B 97/08 |
| 2012/0085267 | A1 * | 4/2012 | Kenny | F16M 11/2014 108/20 |
| 2014/0144352 | A1 * | 5/2014 | Roberts | A47B 21/0314 108/147 |
| 2015/0272316 | A1 * | 10/2015 | Flaherty | A47B 3/0818 108/116 |
| 2020/0029683 | A1 | 1/2020 | Xiang | |
| 2020/0359782 | A1 * | 11/2020 | Ballendat | A47B 9/12 |

FOREIGN PATENT DOCUMENTS

| | | | |
|---|---|---|---|
| CN | 112171032 | * | 1/2021 |
| DE | 10203718 | A1 | 7/2003 |
| DE | 102013002003 | * | 8/2014 |
| GB | 2214069 | * | 8/1889 |
| GB | 340901 | A | 10/1929 |
| GB | 820396 | A | 9/1959 |
| KR | 20170109792 | * | 10/2017 |
| KR | 102340316 | * | 12/2021 |
| WO | 2018141344 | | 8/2018 |

* cited by examiner

CONVERTIBLE TABLE

BACKGROUND

People use tables in everyday life. However, conventional tables usually have a fixed height and do not allow for adjustment or easy adjustment to fit different needs by people. Consequently, people of different heights and/or with different needs may experience inconvenience or feel uncomfortable when using conventional tables. Therefore, there is a need for a convertible table that allows easy and rapid adjustment of the elevation of the table to fit people of different heights and also satisfy different application requirements.

SUMMARY

The present disclosure relates to a convertible table, and more particularly to a convertible table that can transform among multiple height positions to, for example, transform from a dining table height position to a coffee table height position. The height of the table may be adjusted by rotating a shaft of a table converting mechanism to slide the plurality of supporting legs in corresponding leg mounting tracks simultaneously in different directions to fold or unfold the plurality of supporting legs. With the height adjustability, the convertible table may work as, for example, a desk, conference table, standing desk, coffee table, dining table, console table, outdoor table, table tennis table, or other type of table.

In some embodiments, a convertible table may comprise a tabletop, a plurality of supporting legs connected to the tabletop, a plurality of leg mounting tracks for receiving the plurality of supporting legs, an actuator, an input shaft coupled to the actuator, a driver gearbox coupled to the input shaft, and at least one output shaft coupled to the input shaft via the driver gear box. Each leg mounting track may comprise, for example, a guide rail and a sliding element. The sliding element may be connected to an end of each supporting leg and configured to slidably engage on the guide rail.

In some embodiments, a convertible table may comprise a tabletop, a plurality of supporting legs connected to the tabletop, and a means for altering the height of the tabletop by controlling the sliding positions of the plurality of supporting legs to raise or lower the tabletop.

In some further embodiments, a method of operating a convertible table between a first position and a second position is disclosed. The convertible table may comprise a table top, a plurality of legs connected to the tabletop, an actuator, an input shaft removably coupled to the input shaft, a driver gearbox coupled to the input shaft, and at least one output shaft coupled to the input shaft via the driver gear box. The disclosed method may comprise operating the actuator in a first direction to allow one or more of the plurality of supporting legs to lower the tabletop to reach the first position, operating the actuator in a second, opposite direction to allow one or more of the plurality of supporting legs to raise the tabletop to reach the second position; and removing the actuator when the first position and/or the second position is reached, as desired.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and drawings, included herewith. A more extensive presentation of features, details, utilities, and advantages of the present disclosure is provided in the following written description of various embodiments of the disclosure, illustrated in the accompanying drawings, and defined in the appended claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the disclosure.

DETAILED DESCRIPTION

Figure 1:
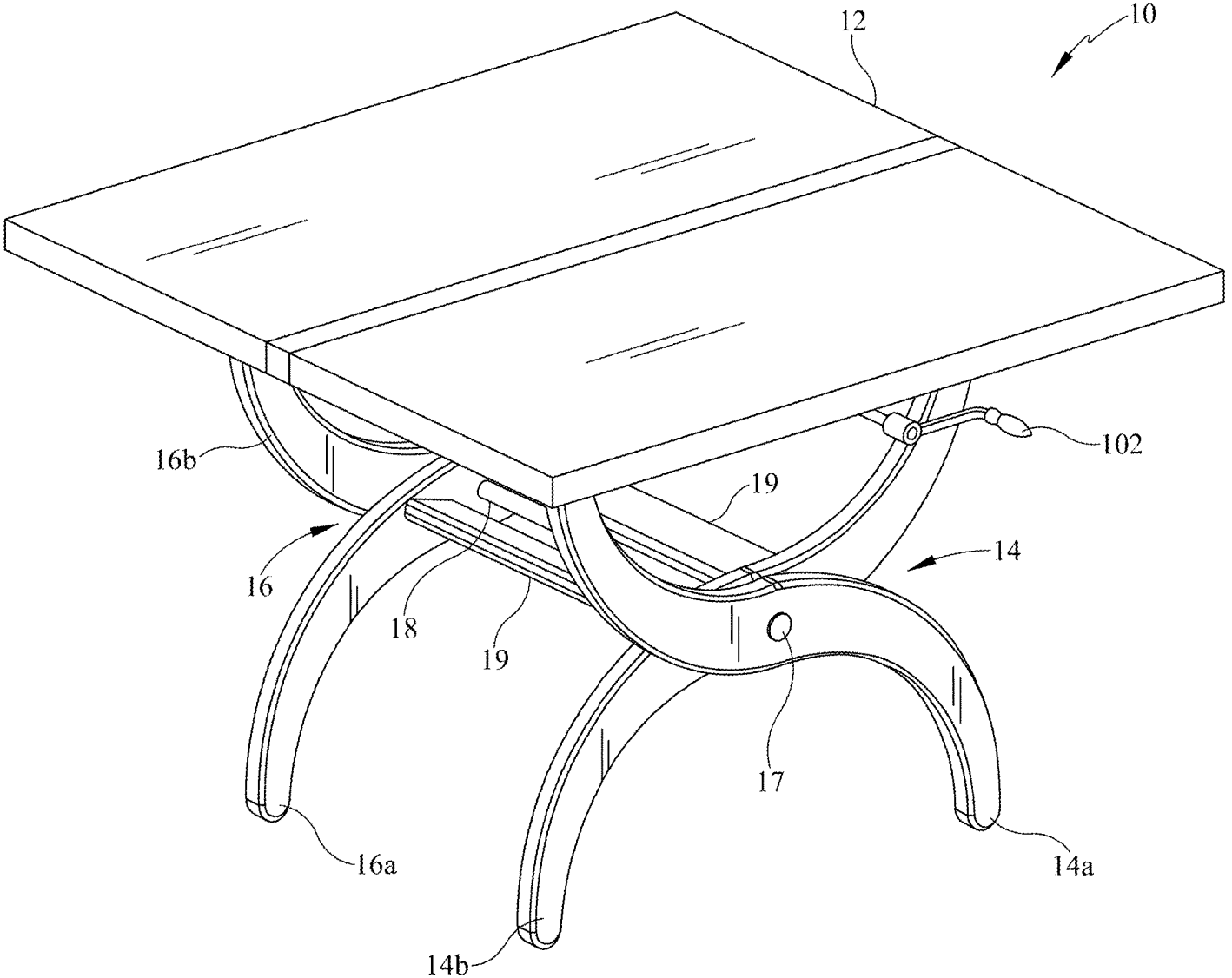
FIG. 1 is a top perspective view of a convertible table, according to an embodiment of the present disclosure.

It is to be understood that a convertible table is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to direct physical or mechanical connections or couplings. It should be noted that the rotation mechanism could vary greatly and still accomplish the same intent.

Turning now to the drawings, wherein like numbers denote like parts throughout the several views, a convertible table adjustable to different heights in accordance with various embodiments will be described with reference to the accompanying drawings. Referring to FIG. 1, a convertible table 10 according to an embodiment of the present disclosure is shown. The convertible table 10 may comprise a tabletop 12 supported by a first pair of legs 14 and a second pair of legs 16. Although the tabletop 12 depicted and described here is a rectangular table, it will be appreciated that the convertible table 10 may take any shapes, for example, the tabletop 12 may be square, elongated, oval, elliptical, circular, polygonal, irregular shaped, or any other shape. The tabletop 12 may be made of, for example, wood, including but not limited to furniture grade hardwoods (e.g., walnut, oak, maple, hickory, cherry, alder etc.), soft woods (e.g., pine, cedar, redwood, etc.), plywood, plastic, metal, composite, laminate, stone, marble, concrete, glass, or other known materials commonly or sometimes used for tabletop surfaces.

Figure 2:
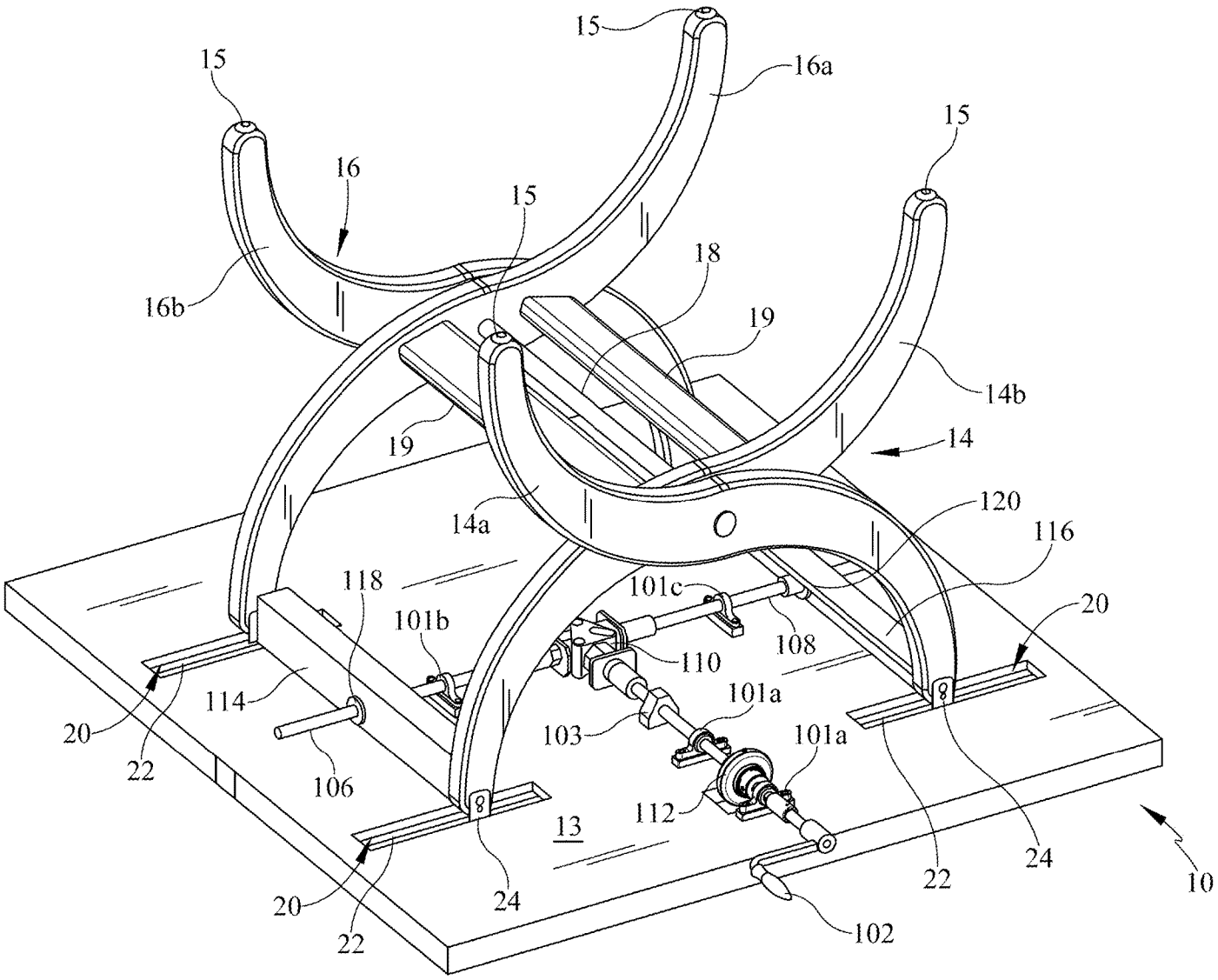
FIG. 2 is a bottom perspective view of the convertible table of FIG. 1.
Figure 5:
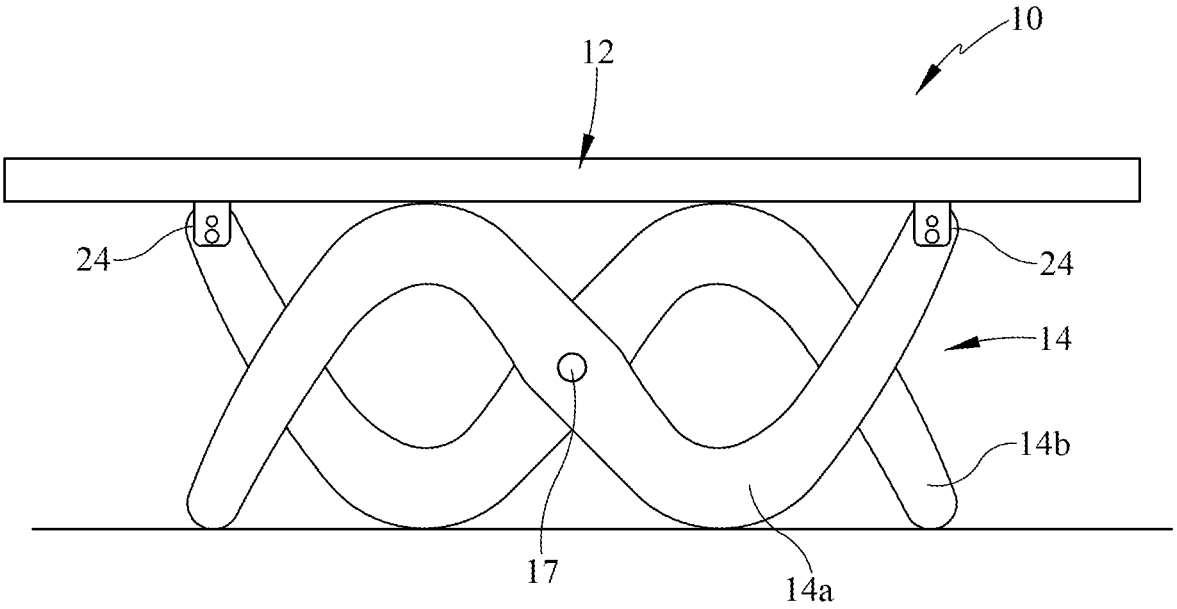
FIG. 5 is a side view of the convertible table of FIG. 1 in a first position.
Figure 6:
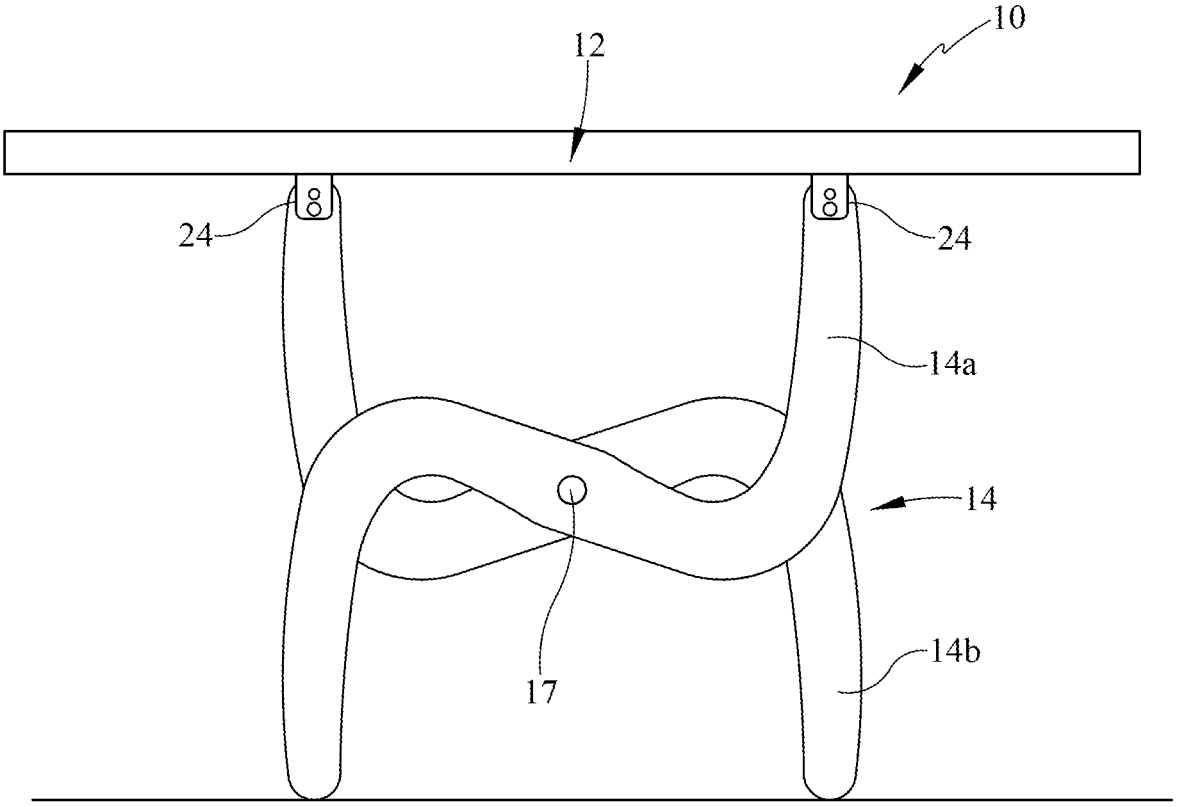
FIG. 6 is a side view of the convertible table of FIG. 1 in a second position.

Best shown in FIG. 2, the first pair of legs 14 may include a first leg 14*a* and a second leg 14*b*, and the second pair of legs 16 may include a third leg 16*a* and a fourth leg 16*b*. In some embodiments, each of the four legs 14*a*, 14*b*, 16*a*, and 16*b* may be in an "S" shape, as one example, and may include a foot 15 at the leg end for contacting the ground. It should be understood that other shapes for the legs 14*a*, 14*b*, 16*a*, and 16*b* may also be acceptable, depending on aesthetic preferences. The legs 14*a*, 14*b*, 16*a*, and 16*b* may be made of any material capable of supporting the tabletop 12, such as wood, plastic, metal, composite, etc., and can be, but need not be, of the same material as the tabletop 12. As shown in FIGS. 1 and 2, the first pair of legs 14 and the second pair of legs 16 may be pivotally connected to each other by a central leg shaft 18. In some embodiments, the central leg shaft 18 may be a long shaft extending through holes 17 (only the one on the first leg 14*a* is visible in the figures) at desired pivot points in each leg 14*a*, 14*b*, 16*a*, and 16*b* respectively, and may be secured with one or more fasteners, such as nuts, on the head of the shaft. Alternatively, the central leg shaft 18 may be a bolt, rivet, pin, or other device that allows for relative movement between the first pair of legs 14 and the second pair of legs 16. The first leg 14*a* and the second leg 14*b*, and the third leg 16*a* and the fourth leg 16*b* may be connected in such a manner that in the side view, the first pair of legs 14 and the second pair of legs 16 may have the appearance of boomerangs, while other configurations may also be acceptable. To improve the stability of the convertible table 10, in some embodiments, one or more stretchers 19 may be used to further connect and support the first pair of legs 14 and the second pair of legs 16 besides the central leg shaft 18. In some embodiments as shown here, the stretchers 19 are located on either side of the central leg shaft 18 between the first pair of legs 14 and the second pair of legs 16, and connected to the second leg 14*b* and the third leg 16*a* in any manner known in the industry, such as welding, adhesion, molding, fastening, etc. As will be described in more detail below, the first pair of legs 14 and the second pair of legs 16 may be connected to the tabletop 12 in such a manner to be able to slide through a plurality of positions with respect to one another, providing the tabletop 12 with different heights, for example, and without limitation, a first position (as shown in FIG. 5) as a coffee table and second position (as shown in FIG. 6) as a dining table.

Figure 3:
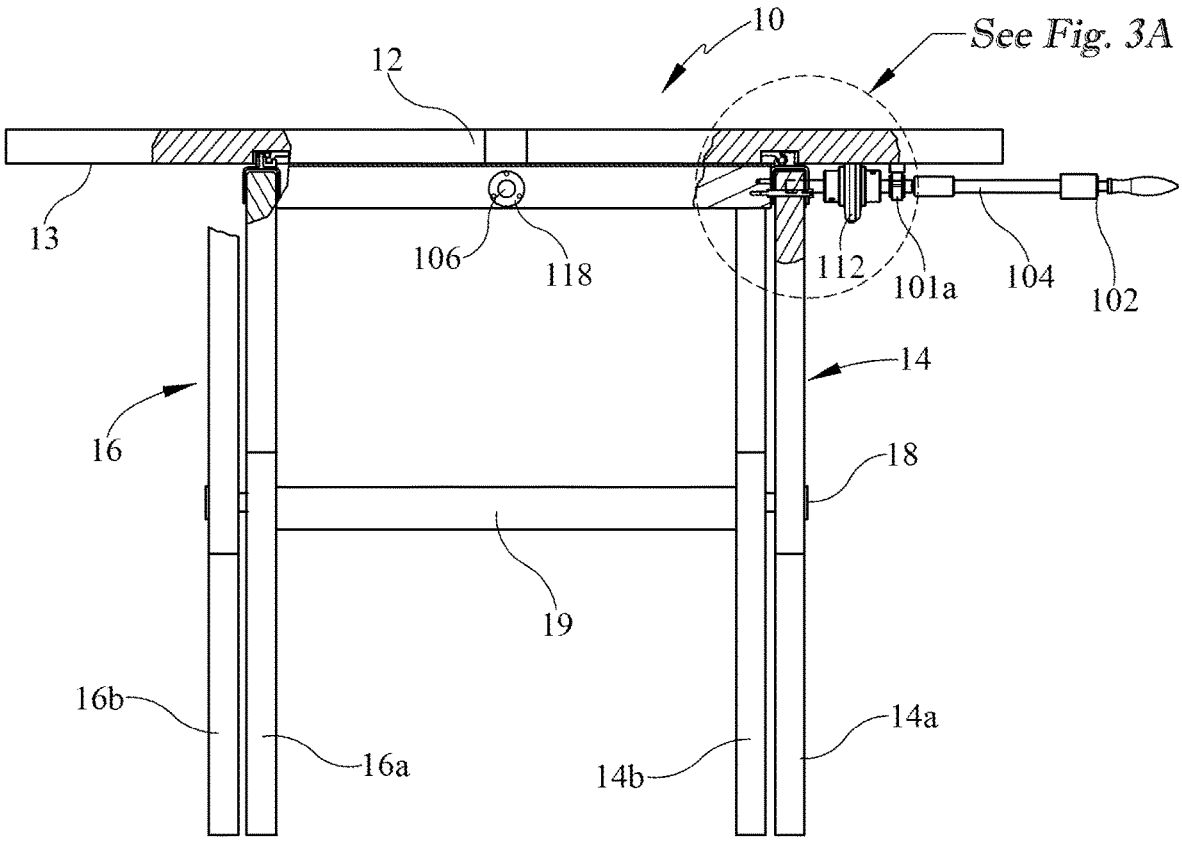
FIG. 3 is a side view of the convertible table of FIG. 1, with partial cutaway.
Figure 3A:
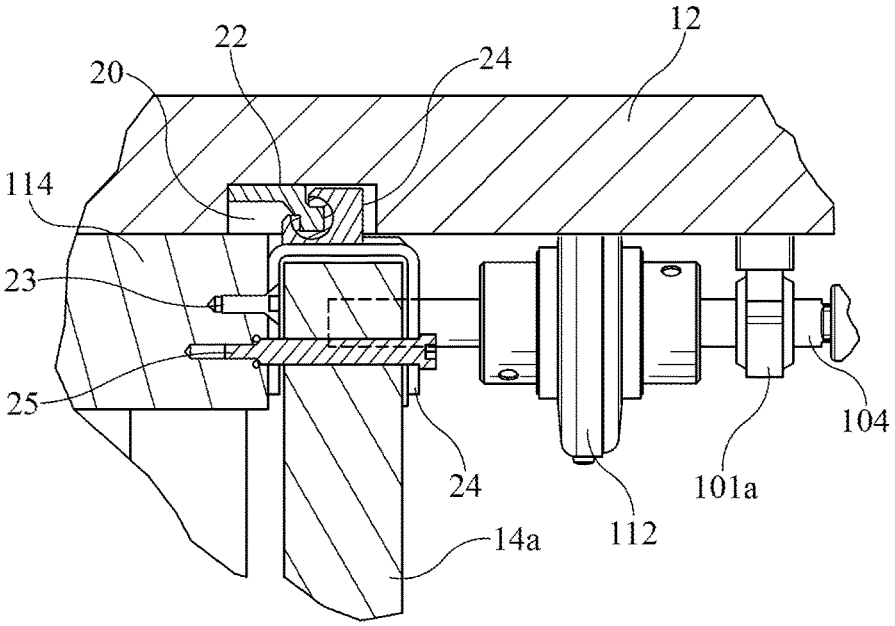
FIG. 3A is a detail view of a portion of the convertible table of FIG. 3.

Still referring to FIG. 2, an underside of the convertible table 10 is shown. A bottom surface 13 of the tabletop 12 may include a plurality of multi-position leg mounting tracks 20 that connect legs 14*a*, 14*b*, 16*a*, and 16*b* to the tabletop 12. In some embodiments, the leg mounting track 20 may be integral with the bottom surface 13 of the tabletop 12, such as a slot through molding, routing, casting, or machining. Alternatively, the leg mounting track 20 may be a separate component, such as a bracket, attached to the bottom surface 13 of the tabletop 12 in any known manner, such as welding, adhesion, molding, fastening, etc. According to the embodiment as shown in FIG. 2, the leg mounting track 20 is a slot built in the bottom surface 13 of the tabletop 12, and includes a guide rail 22 and a sliding element 24. The guide rail 22 may, for example, be a projecting linear bar on or in which the sliding element 24 may slidably engage. In some embodiments, as shown in FIG. 3A, the sliding element 24 may be a leg sliding bracket 24 and be attached to the first leg 14*a* through a leg fastener 25, such as a shoulder bolt. The leg mounting track 20, the guide rail 22, and the sliding element 24 may be constructed of one or more of metal, plastic, composite, or other materials known in the industry. The plurality of mounting tracks 20 may be located parallel to one another as shown in FIGS. 2 and 4.

Figure 4:
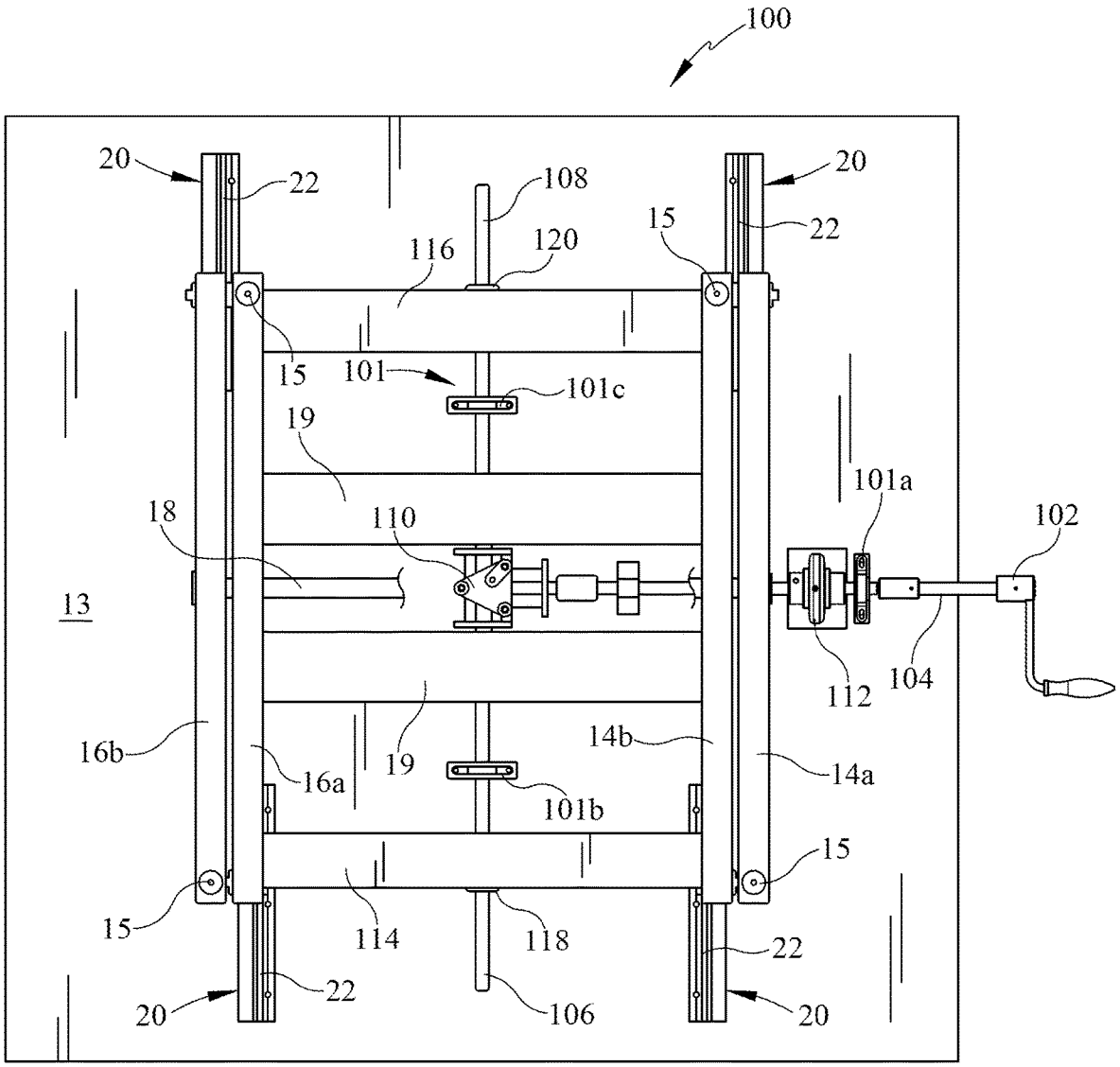
FIG. 4 is a bottom plan view of a table converting mechanism of the convertible table of FIG. 1.

FIGS. 2, 3, 3A, and 4 illustrate a table converting mechanism 100 that embodies the principles of the present disclosure. The table converting mechanism 100 is a means for altering the height of the tabletop 12 by controlling the sliding positions of the first and second pairs of legs 14 and 16 to raise or lower the tabletop 12 (e.g., the table converting mechanism 100 as described below) in some embodiments. As illustrated, the table converting mechanism 100 mounted on an associated carriage system or frame 101 may comprise an actuator 102, an input shaft 104, a first output shaft 106, a second output shaft 108, and a driver gearbox 110. The table converting mechanism 100 may control one or more sliding positions of the first pair of legs 14 and the second pair of legs 16 to raise or lower the tabletop 12. In some embodiments, as shown in FIGS. 2 and 4, the carriage frame 101 may comprise a first bearing block 101*a* for holding the input shaft 104, a second bearing block 101*b* for holding the first output shaft 106, a third bearing block 101*c* for holding the second output shaft 108, and a stop block 103 for limiting the telescoping rotation range of the input shaft 104 to avoid potential damage to the table converting mechanism 100 due to over-tightening. The actuator 102 may be a removable hand crank 102, or some other suitable elements such as a lever, a knob, or a selector, coupled to the input shaft 104. In some embodiments, the hand crank 102 and the input shaft 104 may be combined as a single intact structure element. The input shaft 104, the first output shaft 106, and the second output shaft 108 may be threaded rod made of metal, and the input shaft 104 may transmit the torque/power caused by a rotation to the first and second output shafts 106 and 108 via the driver gearbox 110. Then, the first and second output shafts 106 and 108 may control the sliding motion of the legs 14*a*, 14*b*, 16*a*, and 16*b* simultaneously by rotationally moving a first cross bar 114 and a second cross bar 116 thereon. In some embodiments, the first and second cross bars 114 and 116 may be in an angle bracket configuration, such as an L-shaped bracket as best shown in FIG. 2. It should be understood that other shapes for the first and second cross bars 114 and 116 may also be acceptable, depending on aesthetic preferences. The first cross bar 114 may connect to the second leg 14*b* and the third leg 16*a*, and the second cross bar 116 may connect to the first leg 14*a* and the fourth leg 16*b*, thus allowing the first pair of legs 14 and the second pair of legs 16 move concurrently. The connection between the first and second cross bars 114 and 116 and the legs 14*a*, 14*b*, 16*a*, and 16*b* may be in any manner known in the industry, such as welding, adhesion, molding, fastening, etc. In some embodiments, as shown in FIG. 3A, the first cross bar 114 may be connected to the leg sliding bracket 24 through a bracket fastener 23, such as a flat screw, to control the sliding motions of the first leg 14*a*. The first and second output shafts 106 and 108 may connect to the first and second cross bars 114 and 116 with a first fastener 118 and a second fastener 120 respectively. In some embodiments, the first fastener 118 and the second fastener 120 may be, for example, Acme nuts or similar items such as threaded collars. In some other embodiments, one example of which is shown in FIG. 7, the second output shaft 108 may be omitted, such as when the ends of one of the two pairs of legs 14 or 16 are fixed on the bottom surface 13 of the tabletop 12, while the ends of the other pair of legs 14 or 16 are movably connected on the bottom surface 13 of the tabletop 12, or some other similar situations.

The driver gearbox 110 (three-way driver gearbox as shown in the figures and two-way driver gearbox in some embodiments having only one output shaft) may threadedly engage with the input shaft 104, the first output shaft 106, and the second output shaft 108 in a telescoping manner respectively. As shown in FIG. 4, the axis of the input shaft 104 may be positioned, for example, perpendicular with the axes of the first and second output shafts 106 and 108 via the driver gearbox 110. The driver gearbox 110 may change the rotation directions of the first and second output shafts 106 and 108 from the input shaft 104 with a right angle, allowing (in this example) a 90-degree turn of torque/power transmission. The driver gearbox 110 may be a helical gearbox comprising two sets of spiral bevel gears, which transfer the telescoping rotation of the input shaft 104 to the telescoping rotations of the first and second output shafts 106 and 108 with various speed ratios (e.g., 1:1, 2:1, 3:1, etc.). In order to easily actuate the table converting mechanism 100, it may be desirable to reduce the mechanical friction effects, such as the mechanical friction between the rotating shaft and the bearing block. For the same reason, in some embodiments, the driver gearbox 110 may preferably have a speed ratio such as 2:1 to reduce the force required to actuate the actuator 102 or to reduce the number of turns required to move the table from the first position to the second position, and vice versa. Such embodiments may allow for changes in axis rotation along with a smooth transfer of torque/power with minimal backlash.

In operation, a user may raise or lower the tabletop 12 by controlling the actuator 102, for example, by rotating the hand crank 102 as shown in FIGS. 1, 2, 3, and 4. Rotating the hand crank 102 in one direction (e.g., clockwise) may rotate the input shaft 104 along with the first and second output shafts 106 and 108 in a certain telescoping axial movement direction, thus allowing the sliding element 24 to slide in the leg mounting track 20 in a certain direction, for example, all sliding elements 24 may slide towards the center of the tabletop 12. Accordingly, the first pair of legs 14 and the second pair of legs 16 connected to the sliding elements 24 may form an "X" shaped configuration to raise the tabletop 12 as shown in FIG. 6. Similarly, a rotation of the hand crank 102 in an opposite direction (e.g., counterclockwise) may lower the tabletop 12 as the X-shaped configuration formed by the two pairs of legs 14 and 16 may collapse with the first pair of legs 14 and the second pair of legs 16 becoming substantially parallel to each other with the sliding elements 24 sliding towards the perimeter of the tabletop 12.

Figure 7:
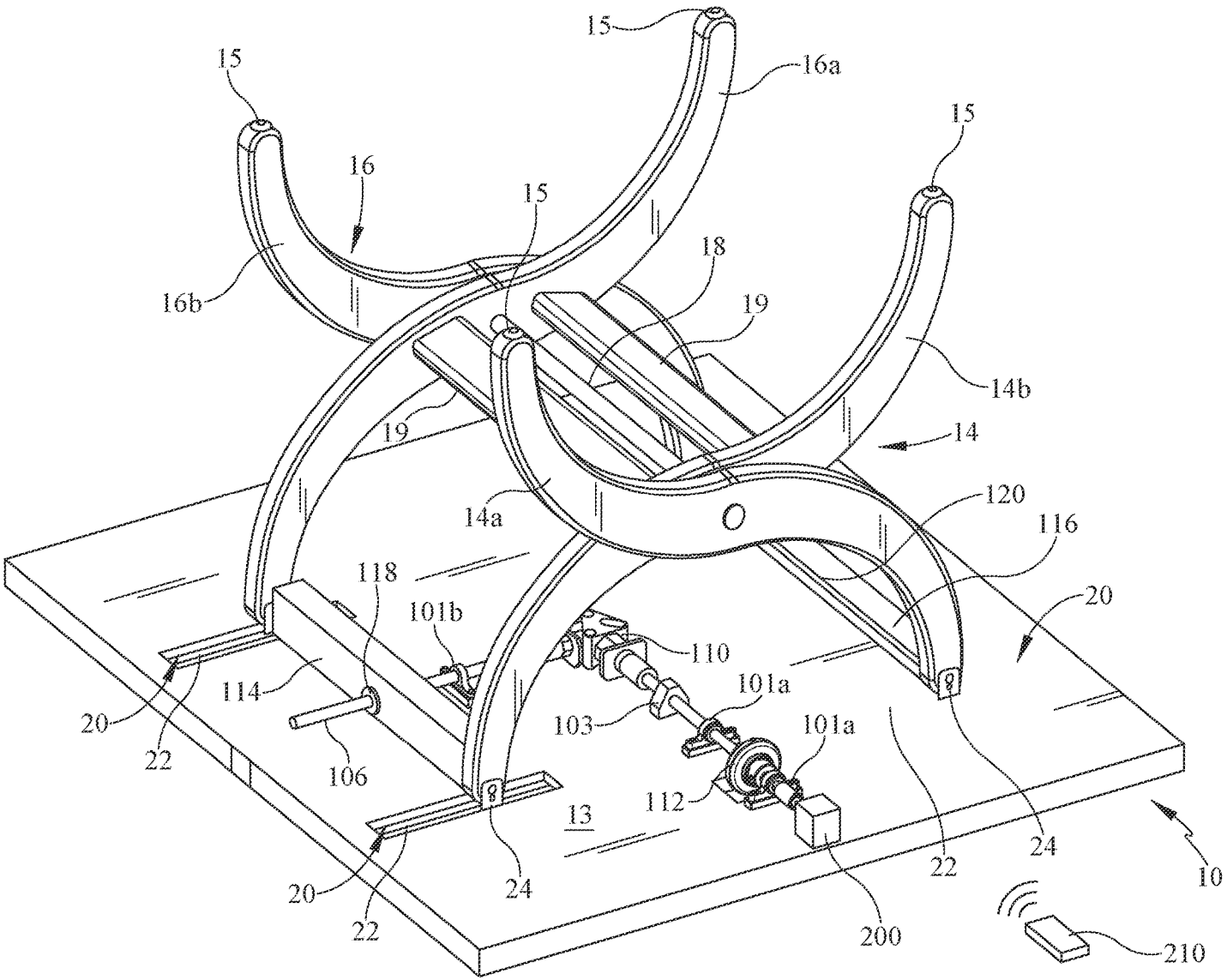
FIG. 7 is a bottom perspective view of the convertible table of FIG. 1 according to another embodiment.

It should be noted that the actuator 102 may be in different forms, for example, an electric motor 200 may be used in this regard (see, e.g., FIG. 7). In such embodiments, a user may press or otherwise actuate an electrical switch 102 on the electric motor 200 to activate the telescoping rotation of the input shaft 104 in the desired direction to raise or lower the tabletop 12. In some embodiments, the actuator 102 may be interfaced with one or more remote devices 210 via various communication standards (e.g., Ethernet, Wi-Fi, Bluetooth, or ZigBee). The remote device may 210 include, but not limited to a smartphone, a tablet, a personal digital assistant, a wearable device, or other networked computing device with an interface capable of communicating with the actuator 102 (e.g., using a web interface or a dedicated app). Through the remote device 210, the actuator 102 may be controlled and/or the actuator 102 may provide user feedback.

In some embodiments, a lock/safety mechanism with a self-braking feature may be provided to prevent potential backwinding of the table converting process and potential damage to the table converting mechanism 100 due to over-tightening. For example, a hand crank 102 may be coupled to the input shaft 104 via a clutch system 112, and the clutch system 112 may disengage the input shaft 104 from the driver gearbox 110 automatically once the tabletop 12 reaches the first position (as shown in FIG. 5) or the second position (as shown in FIG. 6). With a removable actuator 102, a user may also remove the actuator 102 once the desired height position of the tabletop 12 is achieved, to avoid accidently actuating the table converting mechanism 100. In such a manner, a user may safely use the convertible table 10 at any height positions as desired.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein, unless characterized otherwise, are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

The foregoing description of methods and embodiments has been presented for purposes of illustration. It is not intended to be exhaustive or to limit the disclosure to the precise steps and/or forms disclosed, and obviously many modifications and variations are possible in light of the above teaching. It is intended that the scope of the disclosure and all equivalents be defined by the claims appended hereto.

What is claimed is:

1. A convertible table, comprising:

a tabletop;

a plurality of supporting legs, each of said supporting legs comprising a first end and a second end and a single pivot point therebetween, wherein only said first end of each of said support legs is connected to said tabletop, said second end of each of said support legs is free;

a plurality of leg mounting tracks in a surface of said tabletop for receiving said first end of said plurality of supporting legs, wherein each of said plurality of leg mounting tracks is coplanar with every other one of said leg mounting tracks and comprises a guide rail and a sliding element connected to said first end of each of said plurality of supporting legs, respectively, and said sliding element is configured to slidably engage said guide rail;

a central leg shaft pivotally connecting said supporting legs at said pivot point;

an actuator;

an input shaft coupled to said actuator;

a driver gearbox coupled to said input shaft; and at least one output shaft coupled to said input shaft via said driver gear box.

2. The convertible table of claim 1, wherein said plurality of supporting legs comprises two pairs of supporting legs.

3. The convertible table of claim 2, further comprising one or more stretchers for connecting said two pairs of supporting legs.

4. The convertible table of claim 3, further comprising at least one cross bar for connecting said two pairs of supporting legs, wherein said at least one output shaft is coupled to said at least one cross bar.

5. The convertible table of claim 2, wherein said two pairs of supporting legs have the appearance of boomerangs.

6. The convertible table of claim 2, wherein one of said two pairs of supporting legs is fixedly connected to said table top, and the other pair of supporting legs is movably connected to said tabletop.

7. The convertible table of claim 1, wherein each of said plurality of supporting legs is in an "S" shape.

8. The convertible table of claim 1, further comprising a stop block coupled to said input shaft.

9. The convertible table of claim 1, further comprising at least one bearing block coupled to said input shaft and said at least one output shaft.

10. The convertible table of claim 1, wherein said actuator is selected from the group consisting of a hand crank, a lever, a knob, a selector, and an electrical motor.

11. The convertible table of claim 10, wherein said electrical motor is interfaced with one or more remote devices via one or more communication standards selected from the group of Ethernet, Wi-Fi, Bluetooth, or ZigBee.

12. The convertible table of claim 1, further comprising a lock/safety mechanism with a self-braking feature.

13. The convertible table of claim 12, wherein said lock/safety mechanism is a clutch.

14. The convertible table of claim 1, wherein said each of said plurality of leg mounting tracks is a slot integral on a bottom surface of said tabletop or a bracket separate from said tabletop.

15. The convertible table of claim 1, wherein said each of said plurality of leg mounting tracks is located parallel to one another.

16. The convertible table of claim 1, wherein said driver gearbox is configured to change the rotation directions of said at least one output shaft from said input shaft.

17. The convertible table of claim 16, wherein said driver gearbox is configured to change the rotation directions of said at least one output shaft from said input shaft in a right angle.

18. The convertible table of claim 1, wherein said driver gearbox is configured to change the rotation speeds of said at least one output shaft from said input shaft.

19. The convertible table of claim 18, wherein said driver gearbox is configured to change the rotation speeds of said at least one output shaft from said input shaft with a 2:1 speed ratio.

20. The convertible table of claim 1, wherein said driver gearbox is a helical gearbox.

21. The convertible table of claim 20, wherein said helical gearbox comprises two sets of spiral bevel gears.

22. A method of operating a convertible table between a first position and a second position, wherein the convertible table has a table top, a plurality of legs, each of said legs having a first end and a second end and a single pivot point therebetween, wherein only said first end of each of said legs is connected to said tabletop, said second end of each of said support legs is free, an actuator, an input shaft removably coupled to said actuator, a driver gearbox coupled to said input shaft, and at least one output shaft coupled to said input shaft via said driver gear box, the method comprising:

operating said actuator in a first direction to allow one or more of said plurality of supporting legs to lower said tabletop to reach said first position;

operating said actuator in a second, opposite direction to allow one or more of said plurality of supporting legs to raise said tabletop to reach said second position; and removing said actuator when said first position and/or said second position is reached, as desired.

* * * * *